US006039128A

United States Patent [19]

Brunato

[11] Patent Number: 6,039,128

[45] Date of Patent: Mar. 21, 2000

[54] METHOD AND SYSTEM FOR OBTAINING CORE SAMPLES DURING THE WELL-DRILLING PHASE BY MAKING USE OF A CORING FLUID

[75] Inventor: Siro Brunato, Castelfranco Veneto, Italy

[73] Assignee: Hydro Drilling International S.p.A., Alessandria, Italy

[21] Appl. No.: 08/899,117

[22] Filed: Jul. 23, 1997

[30] Foreign Application Priority Data

Jul. 26, 1996 [IT] Italy ..... MI96A1574

[51] Int. Cl.[7] ..... E21B 21/06

[52] U.S. Cl. ..... 175/70; 175/66; 175/206

[58] Field of Search ..... 175/65, 70, 206, 175/66, 40

[56] References Cited

U.S. PATENT DOCUMENTS

| | | | |
|---|---|---|---|
| 3,123,157 | 3/1964 | Graham . | |
| 3,693,733 | 9/1972 | Teague | 175/66 |
| 4,321,968 | 3/1982 | Clear . | |
| 4,496,012 | 1/1985 | Savins . | |
| 4,708,212 | 11/1987 | McAuley et al. . | |
| 4,860,836 | 8/1989 | Gunther . | |
| 5,439,048 | 8/1995 | Osman et al. . | |
| 5,458,198 | 10/1995 | Hashemi et al. . | |
| 5,535,834 | 7/1996 | Naraghi et al. | 175/40 |
| 5,715,896 | 2/1998 | Naraghi | 175/40 |

FOREIGN PATENT DOCUMENTS

94/23180 10/1994 WIPO .

*Primary Examiner*—William Neuder
*Assistant Examiner*—Zakiya Walker
*Attorney, Agent, or Firm*—Nixon & Vanderhye P.C.

[57] ABSTRACT

A method and system for obtaining core samples using a coring fluid. During the drilling phase of hydrocarbon wells and the like, drilled with existing drilling systems, the bit that drills the well is driven by a string of rotating pipes and drilling mud is introduced in the rotating pipes. The drilling mud rises carrying with it the cuttings produced by the drill bit. Alternatively to the current operating method, the rotating pipes can be removed and a special piece of equipment called a core barrel is mounted thereon. The rotating pipes thus equipped for collection of the "core" are then lowered into the well. According to the present invention, when the rotating pipes are at the bottom of the hole, a sufficient volume of a colloidal, viscous coring or embedding fluid is introduced into the mud circuit to encapsulate a sample of the cuttings, for lifting to the surface and subsequent analysis. The fluid prevents the cuttings from being altered by the drilling mud. The present invention also discloses a novel arrangement of the drilling mud flow circuit for implementation of the method.

7 Claims, 1 Drawing Sheet

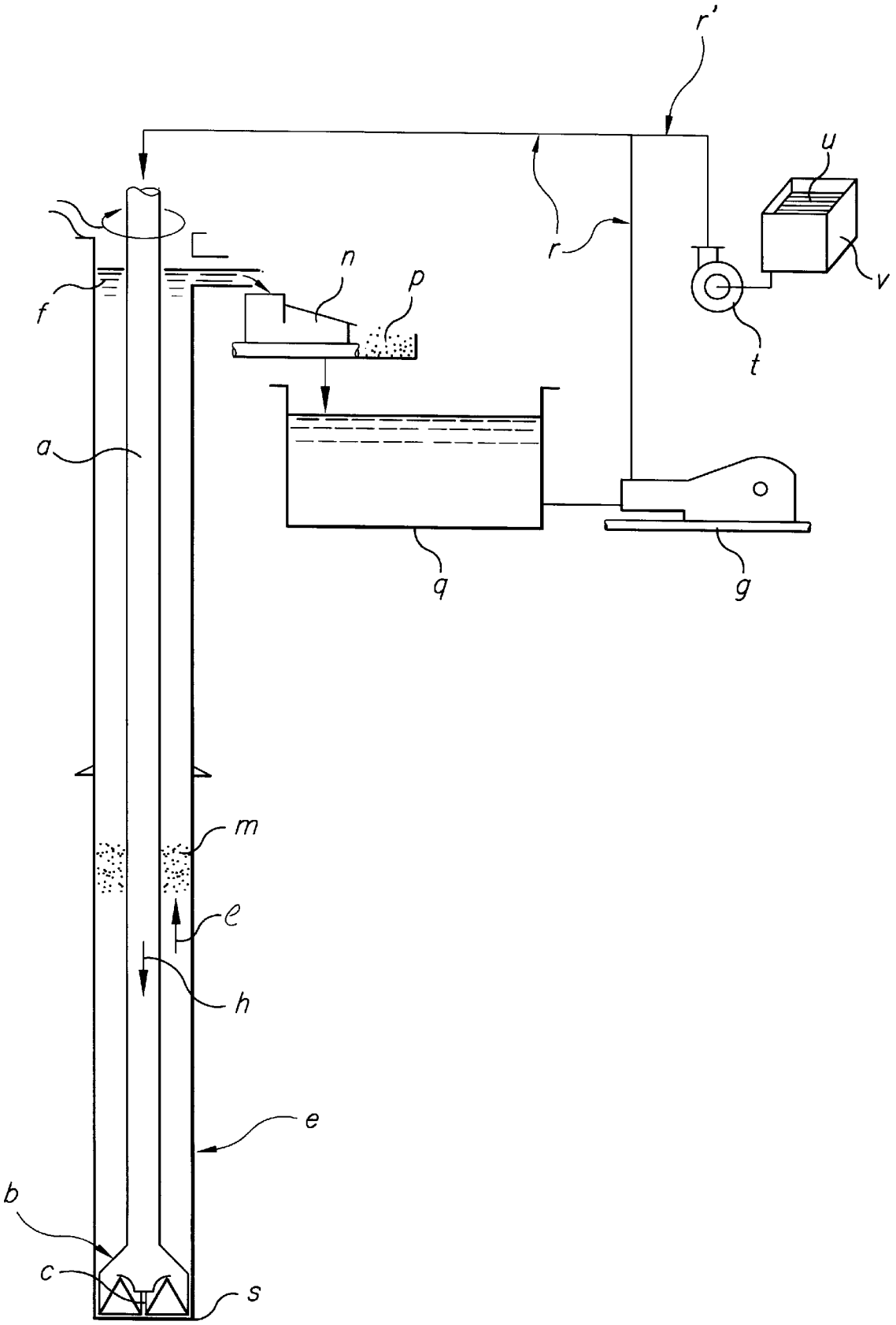
r'
u
r
n
p
v
f
t
a
q
g
m
e
h
e
b
c
s

METHOD AND SYSTEM FOR OBTAINING CORE SAMPLES DURING THE WELL-DRILLING PHASE BY MAKING USE OF A CORING FLUID

BACKGROUND OF THE INVENTION

1. Field of the Invention

The present invention relates to a method and system, for obtaining core samples during the drilling phase of wells, such as hydrocarbon wells and the like, by making use of a coring or encapsulating fluid.

2. Description of the Related Art

Particular reference will be made below to drilling of hydrocarbon wells, in the oil sector, but it is obvious that the invention can be extended to any field of application in which it might be necessary to obtain core samples during the drilling phase.

As is known, during drilling of a well, core samples must be obtained at predetermined depths intervals, that is samples of underground formations must be collected in order to carry out the necessary analyses at the surface to ascertain the type of rock that is being penetrated and identify any traces of hydrocarbon mineralisation, detection of which is the main purpose of well drilling.

According to the current methodology, coring operations take place according to the sequence below:

drilling is suspended mud is circulated in the well for a long enough period to ensure that formation fluids do not enter the bore hole the rotating drill pipes are lifted to the surface a special piece of equipment called a corer or core barrel is assembled ready the corer is lowered to bottom-hole by means of the pipes coring is carried out the corer is lifted to the surface the cores are collected.

The main aim of the invention is to allow collection of "cores" from bottom-of the well, avoiding performance of the work steps listed above and in particular avoiding removal of the rotating pipes from the well.

In the present state of the art of drilling, rock debris produced by the chipping action of the drill bit, which will be referred to henceforth by the English term "cuttings", are lifted from the well bottom to the surface by the circulation of so-called drilling mud, which, being pumped continually, travels downwards inside the constantly rotating drill pipes, then out through nozzles placed on the drill bit, to return upwards along the hollow annular space existing between the drill pipes and the hole bored by the bit.

Thus, the well bottom is continually cleaned, cuttings are removed and lifted to the surface, where they are collected for sampling and analysis at predetermined intervals during drilling.

With such a method, the cuttings carried to the surface from the well bottom are in direct contact with the mud that carries them upwards and obviously undergo more or less thorough washing which, though not altering their geological nature, nevertheless masks and makes uncertain the identification of fluid in the formation (water, oil, gas), thus eliminating any practical possibility of a qualitative and quantitative interpretation that would have been highly desirable.

SUMMARY OF THE INVENTION

An object of the present invention is to overcome the drawbacks of the prior art and therefore safeguard the nature of the cuttings during lifting to the surface, to allow optimal analysis of the mineralisation fluid contained in the pore spaces and interstices of the cuttings themselves, and conduct a sound paleontological analysis of the fossils belonging to the sampling depth.

Yet another aim of the invention is to achieve economic advantages and superior results with respect to the current practice in the field, in view of the considerable time saved by eliminating the current coring procedure.

These aims are achieved, with the method and arrangement of the equipment according to the invention, thanks to the characteristics listed in the appended independent claims.

Essentially, according to the invention, in order to obtain core samples of underground formations, drilling and mud circulation in the bore are momentarily suspended, while a certain volume of coring matrix fluid, that is to say a fluid with an adhesive effect that serves to encapsulate the cuttings, is introduced into the mud circuit at surface. Normal mud circulation is then resumed, pushing the matrix fluid to the well bottom, after which drilling is resumed, so that the matrix fluid passing through the nozzles in the drill bit hits the cuttings in their virgin state as they are formed and incorporates them in a gelatinous mass, protecting them from direct contact with the mud and thus avoiding the washing effect. The cuttings thus coated by the matrix fluid and pushed upward by the mud circulation reach the surface and are collected and analysed.

Further characteristics of the invention will be made clearer by the detailed description that follows, referring to a purely exemplary and therefore non-limiting embodiment, illustrated in the single FIGURE of the appended drawing.

BRIEF DESCRIPTION OF THE DRAWINGS

The FIGURE illustrates a drilling system provided with means that allow core samples to be obtained according to the invention.

DETAILED DESCRIPTION

With reference to the drawing, a drilling rig comprises drill pipe (a) rotated, by means that are not shown, in the direction of the arrow (d).

The drill pipes (a) end at the bottom in a drill bit (b), and have nozzles (c) on said bit through which flows the drilling mud (f), which fills the well, and is discharged by overflow. The drilling mud is circulated through the drill pipes (a) by means of a pump (g).

The arrows (h) and (l), respectively, indicate the descent of the mud inside the pipes and its return towards the surface, in the hole (e) drilled by the rotating bit.

The letter (m) indicates the cuttings travelling upward inside the hole (e), lifted by the mud flow (f). The mud overflowing the hole at surface of hole (e) goes into a vibrating screen apparatus (n), that carries out separation of the cutting from the mud, a sample of cuttings for analysis being indicated by (p).

The clean mud returning from the well is collected in a tank (q), and from there it is continually pumped by the pump (g) which recirculates it into the drill pipes (a).

In the appended FIGURE indicates the bottom of the well bore.

According to the invention, in setting up the existing rig, a pump (t) is connected to the connecting pipe (r) between the pump (g) and the drill pipe (a) by means of a pipe (r').

The pump (t) draws a matrix fluid (u) from a special tank (v), to introduce it, as needed, into the drill pipe (a).

The core sample matrix fluid (u) is a viscous, colloidal fluid, that serves to encapsulate the cuttings (m) during lifting to the surface, making it possible to achieve the above mentioned advantages.

In fact, when the decision is made to obtain core samples in a matrix during drilling of the well, the operating sequence begins by stopping the mud circulating pump (g) and the drive means for rotation of the drill pipe (a).

Using the auxiliary pump (t) a set volume of matrix fluid (u) is introduced into the mud circuit through the pipes (r, r').

The pump (g) is then reactivated to resume the normal mud circulation (h), (l) which has been temporarily suspended. The volume of matrix fluid (u) is thus pushed downward through the drill pipe (a) and, after the time necessary for the volume of fluid (u) to arrive in the vicinity of the bit (b), drilling is resumed maximizing the bit penetration in order to obtain a high concentration of cuttings at the well bottom.

As the matrix fluid passes through the nozzles (c) of the bit (b), it hits the cuttings (m) in the virgin condition as they are formed and incorporates them in a gelatinous mass, protecting them from direct contact with the mud and thus avoiding the washing effect. The hydraulic sampling operation is limited in time to a period of a few seconds that will be best indicated by operating experience.

The cuttings thus coated with the matrix fluid and pushed upward by the mud circulation reach the surface and are collected there in the usual manner and then analysed more suitably to discover the quality and percentage quantity of original interstitial fluid in the geological formation, belonging to the well-bottom depth investigated.

From the foregoing description it will be clear that the coring method with the use of a matrix fluid according to the invention achieves the specified aims.

It is obvious, however, that the invention is not limited to what is described above and illustrated in the appended drawing, but numerous changes within the reach of an expert can be made to the details and must nevertheless be considered as coming within the scope of the invention itself, as defined by the claims that follow.

I claim:

1. A method of obtaining core samples during the drilling of a well, comprising the steps of:

rotating a drill pipe to drill the well;

introducing drilling mud into the drill pipe, wherein the drilling mud lifts cuttings produced by a drill bit disposed on an end of the pipe to a surface of the well;

introducing a volume of matrix fluid into the drill pipe, the matrix fluid having a colloidal, viscous nature;

encapsulating the cuttings and liquid contained in pore spaces and interstices of the cuttings with the matrix fluid to protect the cuttings from the drilling mud;

lifting the encapsulated cuttings to the surface of the well, wherein the cuttings are protected by the matrix fluid during the upward movement to preserve the original conditions of the cuttings and the liquid contained in pore spaces and interstices thereof taken at the depth of sampling;

wherein the step of introducing a volume of matrix fluid comprises introducing the fluid into the drill pipe at predetermined intervals during drilling, wherein the matrix fluid is pushed downwards towards a bottom of the well by the drilling mud;

and further including the step of stopping the rotation of the drill pipe before the step of introducing the matrix fluid and until the matrix fluid reaches the bottom of the well.

2. The method of claim 1, further comprising the step of temporarily stopping circulation of the drilling mud prior to the step of introducing the matrix fluid into the drilling mud.

3. The method of claim 2, further comprising the step of resuming the circulation of the drilling mud after the step of introducing the matrix fluid.

4. A system for obtaining core samples taken during a drilling phase of a well, comprising:

a rotating drill pipe;

a drill bit disposed at an end of the drill pipe;

a primary pump for circulating drilling mud through a circuit, the drill bit including nozzles through which the drilling mud flows;

means for introducing a volume of colloidal, viscous matrix fluid into the circuit of drilling mud, wherein the matrix fluid encapsulates and protects cuttings and liquid contained in pore spaces and interstices thereof of the samples taken at the time of drilling for subsequent lifting thereof to the surface; and a first collecting tank for storing the matrix fluid;

wherein the means for introducing the matrix fluid comprise a secondary pump which draws the matrix fluid from the first collecting tank and delivers a predetermined amount of the matrix fluid into the circuit of the drilling mud at predetermined intervals after the primary pump has been temporarily stopped.

5. The system of claim 4, further comprising a vibrating screen disposed at a surface of the well, wherein the vibrating screen separates the cuttings encapsulated with the matrix fluid from the drilling mud.

6. The system of claim 5, further comprising a second collecting tank for storing the drilling mud, the drilling mud being circulated from the second collecting tank to the rotating pipe by the primary pump.

7. A system for obtaining core samples taken during a drilling phase of a well, comprising:

a rotating drill pipe;

a drill bit disposed at an end of the drill pipe;

a primary pump for circulating drilling mud through a circuit, the drill bit including nozzles through which the drilling mud flows;

means for introducing a volume of colloidal, viscous matrix fluid into the circuit of drilling mud, wherein the matrix fluid encapsulates and protects cuttings and liquid contained in pore spaces and interstices thereof of the samples taken at the time of drilling for subsequent lifting thereof to the surface; and means for stopping the rotation of the drill pipe before said matrix fluid is introduced and until the predetermined amount of matrix fluid reaches the drill bit.

* * * * *